US006206036B1

(12) United States Patent
Loyd et al.

(10) Patent No.: US 6,206,036 B1
(45) Date of Patent: Mar. 27, 2001

(54) RECREATIONAL WATER RECIRCULATION SYSTEM WITH DOUBLE-SHAFT PUMP MOTOR

(75) Inventors: Casey Loyd; Pedro Vargas, both of Pomona, CA (US)

(73) Assignee: California Acrylic Industries, Inc., Pomona, CA (US)

( * ) Notice: Subject to any disclaimer, the term of this patent is extended or adjusted under 35 U.S.C. 154(b) by 0 days.

(21) Appl. No.: 09/233,718

(22) Filed: Jan. 18, 1999

(51) Int. Cl.[7] ..... E03B 11/16

(52) U.S. Cl. ..... 137/565.31; 137/565.17; 137/563; 137/338

(58) Field of Search ..... 137/565.31, 565.17, 137/563, 338

(56) References Cited

U.S. PATENT DOCUMENTS 2,936,774 * 5/1960 Holley et al. ..... 137/338
3,032,238 * 5/1962 Paulsen ..... 137/565.31
3,515,164 * 6/1970 Dunnous ..... 137/565.31
4,367,785 * 1/1983 Allen ..... 165/283
4,373,220 * 2/1983 Selsted ..... 4/508
4,421,399 * 12/1983 Steube ..... 396/571
4,945,942 * 8/1990 Lund ..... 137/337
5,278,455 * 1/1994 Hamos ..... 307/139
5,484,267 * 1/1996 Rockwood ..... 137/563
5,507,310 * 4/1996 Sordello et al. ..... 137/351
5,593,596 * 1/1997 Bratten ..... 210/741
6,006,398 * 12/1999 Larson et al. ..... 15/314

* cited by examiner

*Primary Examiner*—A. Michael Chambers
*Assistant Examiner*—Thomas L. McShane
(74) *Attorney, Agent, or Firm*—Sheldon & Mak; Denton L. Anderson

(57) ABSTRACT

A pool, spa, hot tub or the like having a basin capable of retaining water, a first pump for recirculating a portion of the water within the basin to inlet jets within the side walls of the basin and a second pump for recirculating water from the basin to additional inlet jets in the side walls of the basin. Both the first pump and the second pump are driven by a single double-shaft electric motor.

19 Claims, 1 Drawing Sheet

RECREATIONAL WATER RECIRCULATION SYSTEM WITH DOUBLE-SHAFT PUMP MOTOR

FIELD OF THE INVENTION

Figure 1:
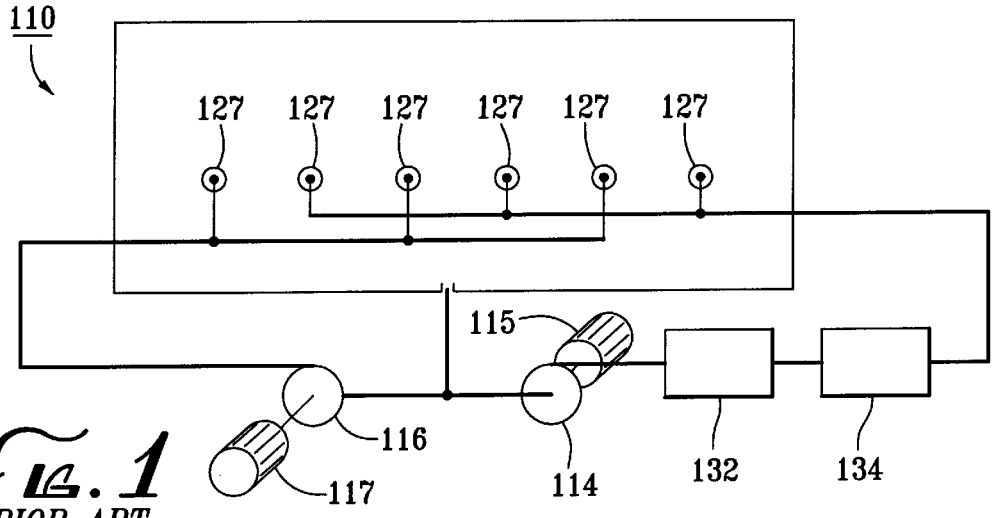
FIG. 1 PRIOR ART

This invention relates generally to recreational water equipment, such as pools, spas, hot tubs and the like, and, more particularly, to water recirculation systems associated with such equipment.

BACKGROUND OF THE INVENTION

Recreational water equipment, such as pools, spas, hot tubs and large recirculating bath tubs have become extremely popular. Typically, in such equipment, water is recirculated from the water holding basin through a water heater and a filter and then back into the basin via a plurality of inlet "jets." The recirculation of the water heats the water, cleans the water and provides a pleasant bubbling or pulsating sensation to those using the equipment.

In the larger varieties of such water recreational devices, two pumps are employed in the water recirculation system. Each pump recirculates water to about one half of the inlet jets. Each pump is driven by a separate electrical pump motor. Typically, only one of the pump motors has multiple speed capability. The other pump operates only in a "high speed" mode. Also, the pump having the multiple speed motor is typically the only one of the two pumps which recirculates water through a water filter.

A problem with the recirculation systems described above is several-fold. First of all, the operation of multiple pumps by separate pump motors requires considerable electrical energy and results in high operating costs. Secondly, users using the equipment must typically operate both pumps in the "high speed" mode in order to operate the recirculation system so that water flows into the basin via all of the inlet jets. If the users of the equipment do not want to operate the recirculation system in the "high" speed mode, then about half of the inlet jets are inoperative.

Accordingly, there is a need for an improved recirculation system operable with water recreational equipment which will be less expensive to operate and which will allow the recirculation of water to all of the inlet jets in both "low speed" and "high speed" modes.

SUMMARY

The invention satisfies this need. The invention is a combination comprising (a) a basin capable of retaining water, the basin having one or more water recirculation outlet ports and a plurality of water recirculation inlet ports, (b) a first pump for recirculating water from the one or more water recirculating outlet ports to one or more of the water recirculating inlet ports, (c) a second pump for recirculating water from the one or more water recirculation outlet ports to one or more of the water recirculation inlet ports, and (d) a single double-shaft electric motor for driving both the first pump and the second pump. Typically, the double-shaft electric motor is capable of operating both pumps in at least two different speeds.

In the invention, the electric motor drives both pump drive shafts in the same radial direction. Accordingly, one of the pumps has a typical "right hand" orientation, whereas the other pump has an atypical "left hand" orientation.

DRAWINGS

Figure 2:
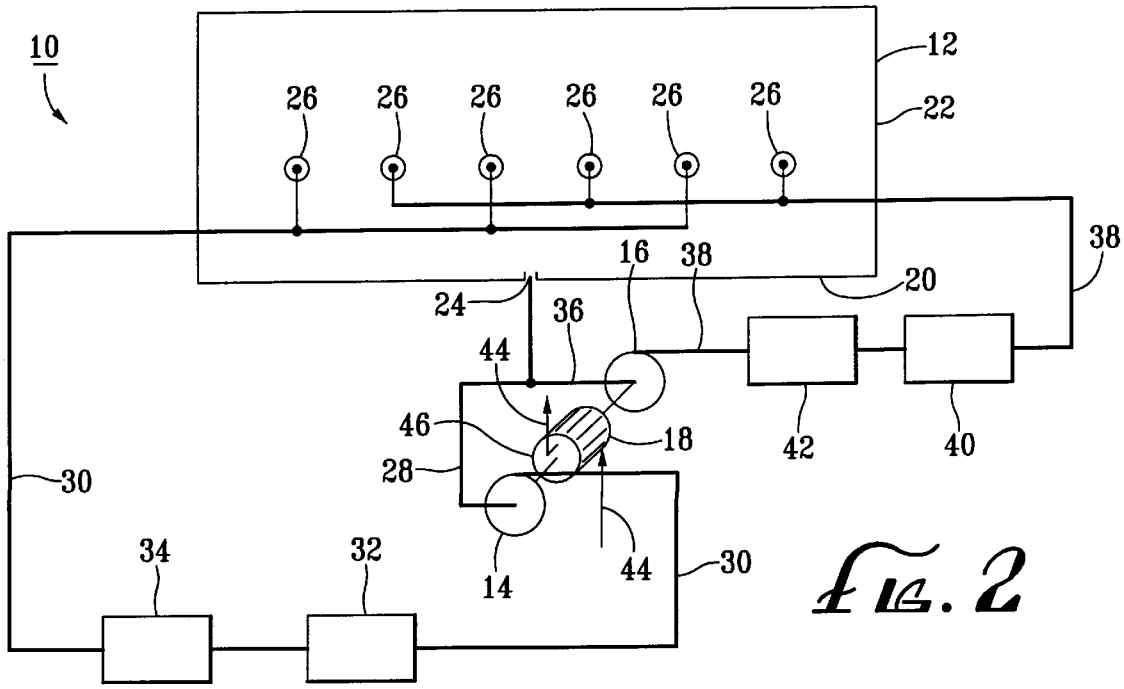

These features, aspects and advantages of the present invention will become better understood with regard to the following description, appended claims and accompanying figures where:

FIG. 1 is a diagrammatic view of water recreational equipment of the prior art; and FIG. 2 is a diagrammatic view of water recreational equipment having features of the invention.

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a combination 10 comprising a basin 12, a first pump 14 for recirculating water to the basin 12, a second pump 16 for recirculating water to the basin 12 and a single double-shaft electric motor 18 for driving both the first pump 14 and the second pump 16.

The basin 12 can be any suitable structure capable of retaining water for recreational use. Typical basins 12 include swimming pools, permanent spas, portable spas, hot tubs and large recirculating bath tubs.

The basin 12 has a bottom wall 20 and side walls 22. The basin 12 also has one or more water recirculation outlet ports 24. Typically, the water recirculation outlet ports 24 are located in the bottom wall 20 of the basin 12. From the water recirculation outlet ports 24, water within the basin 12 can be gravitated out of the basin 12 for recirculation as described below.

The basin 12 also has a plurality of inlet ports 26. Typically, the inlet ports 26 are disposed in the side walls 22 of the basin 12. In spas and hot tubs, various inlet jets 27 are typically disposed within the water recirculation inlet ports 26 to provide users of the equipment 10 with a pleasant bubbling or pulsing sensation.

The first pump 14 is in fluid communication with the one or more water recirculation outlet ports 24. The first pump 14 takes a portion of the water gravitated from the recirculation outlet ports via a first pump suction line 28 and recirculates that water to the tub basin 12 via a first pump discharge line 30 and one or more of the water recirculation inlet ports 26. In a typical embodiment, a first water heater 32 and a first water filter 34 are disposed within the first pump discharge line 30.

The second pump 16 is also in fluid communication with the one or more water recirculation outlet ports 24 via a second pump suction line 36. This second pump 16 is configured to pump water received from the second pump suction line 36 back to one or more of the water recirculation inlet ports 26 via a second pump discharge line 38. Typically, the second pump discharge line 38 comprises a second water filter 40 so that water recirculated by the second pump 16 is cleaned during the recirculation process. Optionally, the second pump discharge line can also comprise a second water heater 42 as well, so that water recirculated by the second pump 16 is heated during the recirculation process.

Both the first pump 14 and the second pump 16 are driven by a single double-shaft electric motor 18. In a typical embodiment, the motor 18 is of a size between about a 5 NEMA frame size and a 145T NEMA frame size. ("NEMA" is the acronym for the National Electrical Manufacturers Association.) In a typical portable spa, the motor 18 can be of a 48 NEMA frame size or a 56 NEMA frame size.

The motor 18 can be as small as a 12 volt motor or at least as large as a 240 volt motor. The smaller motors 18 are typically DC motors and the larger motors are typically AC motors. The AC motors are typically operated at 50–60 hz.

In a typical embodiment, the motor 18 is air-cooled. In a preferred embodiment, the cooling air 44 is flowed countercurrent with respect to the flow of electrical energy through the motor windings. Such counter-current flow can be achieved by drawing cooling air 44 up from below the motor 18 and exhausting the cooling air 44 out through the forward end 46 of the motor 18.

Surprisingly, the operation of the first pump 14 and the second pump 16 by a single double-shaft electrical motor 18 has been found to markedly decrease the operating costs of operating the two pumps. For example, two pumps which would both normally draw about 12 amps of power (a total of about 24 amps for their combined operation), can be operated by the single double-shaft electrical motor on only about 14 amps. This represents a savings of over 40%.

Preferably, the single double-shaft electrical motor 18 can be operated at differing speeds. In a most preferred embodiment, the double-shaft electric motor is a variable speed motor which can be operated at an infinite number of different settings.

In addition to the substantial cost savings achieved by the invention, the invention provides the user of the water recreation equipment 10 with considerably increased utility and flexibility. FIG. 1 illustrated a typical portable spa embodiment of the prior art 110. In this embodiment, a first recirculation pump 114 is operated by a first single-shaft pump motor 115 and a second recirculation pump 116 is operated by a second single-shaft pump motor 117. The first recirculation pump 114 recirculates water through a water heater 132 and a water filter 134, but the second recirculation pump 116 does not recirculate water through a pump or a water heater. Also, it is typical that only the first recirculation pump 114 is capable of being operated at multiple speeds. Most typically, the second recirculation pump 116 can only be operated in a "high speed" mode.

Contrasted with the portable spa of the prior art illustrated in FIG. 1, the portable spa example of the invention 10 illustrated in FIG. 2 has a first recirculation pump 14 and a second recirculation pump 16 driven by a single double-shaft electric motor 18. Both the first recirculation pump 14 and the second recirculation pump 16 recirculate water through separate water filters 34 and 40. Typically, the first recirculation pump 14 recirculates water through a water heater 32, as well. Optionally, the second recirculation pump 16 recirculates water through a water heater 42. Because both pumps 14 and 16 are operated by a single motor 18, where both pumps 14 and 16 are operable at variable speeds, not just in a "high speed" mode. Accordingly, in a "low speed" mode, all of the inlet jets 27 in the embodiment of the invention (FIG. 2) are operable. This is a marked improvement over the configuration of the prior art (FIG. 1), wherein only about half of the inlet jets 127 are operable in a "low speed" mode. Moreover, even in a "high speed" mode, all of the water circulated in the example spa of the invention (FIG. 2) is heated and filtered, whereas in the example of the prior art (FIG. 1), only about one half of the circulated water is heated and filtered in a "high speed" mode.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A combination comprising:

(a) a basin capable of retaining water, the basin having one or more water recirculation outlet ports, a first plurality of water inlet jets and a second plurality of water inlet jets;

(b) a first pump for recirculating water from the one or more water recirculation outlet ports to the first plurality of water inlet jets;

(c) a second pump for recirculating water from the one or more water recirculation outlet ports to one or more of the water recirculation inlet ports; and (d) a single double-shaft electric motor for driving both the first and second pumps.

2. The combination of claim 1 wherein the electric motor has a bottom side and a forward end, and wherein the electric motor is cooled by a counter-current flow of cooling air drawn into the electric motor from the bottom side of the electric motor and exhausted out of the forward end of the electric motor.

3. The combination of claim 2 wherein the electric motor has a forward end, and wherein cooling air is drawn into the electric motor from beneath the electric motor and exhausted out of the forward end of the electric motor.

4. The combination of claim 1 wherein the electric motor is capable of multiple speed settings.

5. The combination of claim 1 wherein the electric motor is capable of an infinite number of speed settings.

6. The combination of claim 1 wherein the motor is between a 5 NEMA frame motor size and a 145T NEMA frame motor size.

7. The combination of claim 1 wherein the motor is between a 48 NEMA frame motor size and a 56 NEMA frame motor size.

8. The combination of claim 1 wherein the electric motor is between about a 12 volt motor and about a 240 volt motor.

9. The combination of claim 1 wherein the motor is an AC motor, operating at between about 50 and about 60 hz.

10. The combination of claim 1 wherein both the first pump and the second pump are capable of recirculating water from one or more of the water recirculation ports through a filter, before returning the water to the basin via the water inlet jets.

11. The combination of claim 1 wherein at least one of the pumps is capable of recirculating water from the one or more water recirculation outlet ports through a heater before returning the water to the basin via the water inlet jets.

12. The combination of claim 1 wherein both pumps are capable of recirculating water from the one or more water recirculation outlet ports through a heater before returning the water to the basin via the water inlet jets.

13. A combination comprising:

(a) a basin capable of retaining water, the basin having one or more water recirculation outlet ports, a first plurality of water inlet jets and a second plurality of water inlet jets;

(b) a first pump for recirculating water from the one or more water recirculation outlet ports, through a filter and heater, to the first plurality of water inlet jets;

(c) a second pump for recirculating water from the one or more water recirculation outlet ports, through a filter, to the second plurality of water inlet jets;

(d) a variable speed, single double-shaft electric motor having a size between a 5 NEMA frame motor size and a 145T NEMA frame motor size.

14. The combination of claim 1 wherein the electric motor has a bottom side and a forward end, and wherein the electric motor is cooled by a counter-current flow of cooling air drawn into the electric motor from the bottom side of the electric motor and exhausted out of the forward end of the electric motor.

15. The combination of claim 14 wherein the electric motor has a forward end, and wherein cooling air is drawn into the electric motor from beneath the electric motor and exhausted out of the forward end of the electric motor.

16. The combination of claim 13 wherein the electric motor is capable of an infinite number of speed settings.

17. The combination of claim 13 wherein the motor is between a 48 NEMA frame motor size and a 56 NEMA frame motor size.

18. The combination of claim 13 wherein the electric motor is between about a 12 volt motor and about a 240 volt motor.

19. The combination of claim 13 wherein both pumps are capable of recirculating water from the one or more water recirculation outlet ports through a heater before returning the water to the basin via the water inlet jets.

* * * * *